US010563506B2

(12) United States Patent
Fisk

(10) Patent No.: US 10,563,506 B2
(45) Date of Patent: Feb. 18, 2020

(54) MINING AND EXCAVATION BIT EXTRACTION TOOL

(71) Applicant: Darel Fisk, Valley Mills, TX (US)

(72) Inventor: Darel Fisk, Valley Mills, TX (US)

( * ) Notice: Subject to any disclaimer, the term of this patent is extended or adjusted under 35 U.S.C. 154(b) by 0 days.

(21) Appl. No.: 15/139,751

(22) Filed: Apr. 27, 2016

(65) Prior Publication Data

US 2017/0314393 A1 Nov. 2, 2017

(51) Int. Cl.
*E21C 35/00* (2006.01)
*E21C 35/18* (2006.01)

(52) U.S. Cl.
CPC ..... *E21C 35/00* (2013.01); *E21C 35/18* (2013.01)

(58) Field of Classification Search
CPC ..... B23P 19/00; B23P 15/00; B23P 11/00
USPC ..... 29/256
See application file for complete search history.

(56) References Cited

U.S. PATENT DOCUMENTS 2,503,426 A * 4/1950 Tower ..... B25B 27/02 173/131
3,752,515 A * 8/1973 Oaks ..... E21C 35/197 299/109
5,875,534 A * 3/1999 Jackson ..... B25B 27/02 29/255
6,478,383 B1 * 11/2002 Ojanen ..... E21C 35/18 299/104
6,526,641 B1 * 3/2003 Latham ..... B25B 27/026 254/18
6,851,758 B2 * 2/2005 Beach ..... E21C 35/197 299/107
7,496,999 B2 * 3/2009 Robarge ..... B25B 13/48 29/255
8,256,081 B2 * 9/2012 Fridman ..... B25B 27/062 29/244
2009/0236572 A1 * 9/2009 Laun ..... B25C 11/02 254/18

* cited by examiner

*Primary Examiner* — Lee D Wilson

(57) ABSTRACT

An extraction tool for removing bullet bits from mining and excavation equipment, including a threaded extraction rod and extractor, a pusher tube.

3 Claims, 2 Drawing Sheets

MINING AND EXCAVATION BIT EXTRACTION TOOL

BACKGROUND OF THE INVENTION

1. Field of the Invention

The present invention relates to mining equipment repair and maintenance.

2. Background Information

Mining and excavation equipment used to bore through dirt and rock often include rotating cylinders from which extend a number of bits (often referred to as "bullet bits", because of their appearance). These bits are engaged in recesses in the rotating excavation drum. As these bits wear or break, they must be removed and replaced. Removing a bit historically is often a time-intensive and even dangerous process, because it involves prying, pounding, and other measures to try to free the bit from its receptacle. Injuries have occurred when the bit suddenly frees, while undergoing such processes. At the very least, the process is very time-consuming, unless one employs often impractical tools and methods as some have previously proposed.

Rankin, in U.S. Pat. No. 8,601,662 proposed a tool to ease extraction of bullet bits, but Rankin's design is complicated, expensive to fabricate, and, appears in practice, to not facilitate the reliable, failure-free extraction of a bullet bit. One way of assessing Rankin is that he missed the design which reliably, inexpensively, quickly and safely removes bullet bits.

Prior to the present invention, therefor, there remained a need for a tool for those needing to extract bullet bits from mining and excavation equipment in a reliable, inexpensive, fast and safe manner.

SUMMARY OF THE INVENTION

In view of the foregoing, the present invention provides a bullet bit extraction tool that, with a minimum of parts, and secure, safe engagement with a to-be-removed bit, meets all of the above-stated goals.

In satisfaction of the stated needs, the design for a bit extractor of the present invention provides a simple structure with (depending on manufacturing preferences) as little as two simple components for 100% reliability in quickly and safely removing bullet bits.

DETAILED DESCRIPTION OF THE PREFERRED EMBODIMENT

Figure 1:
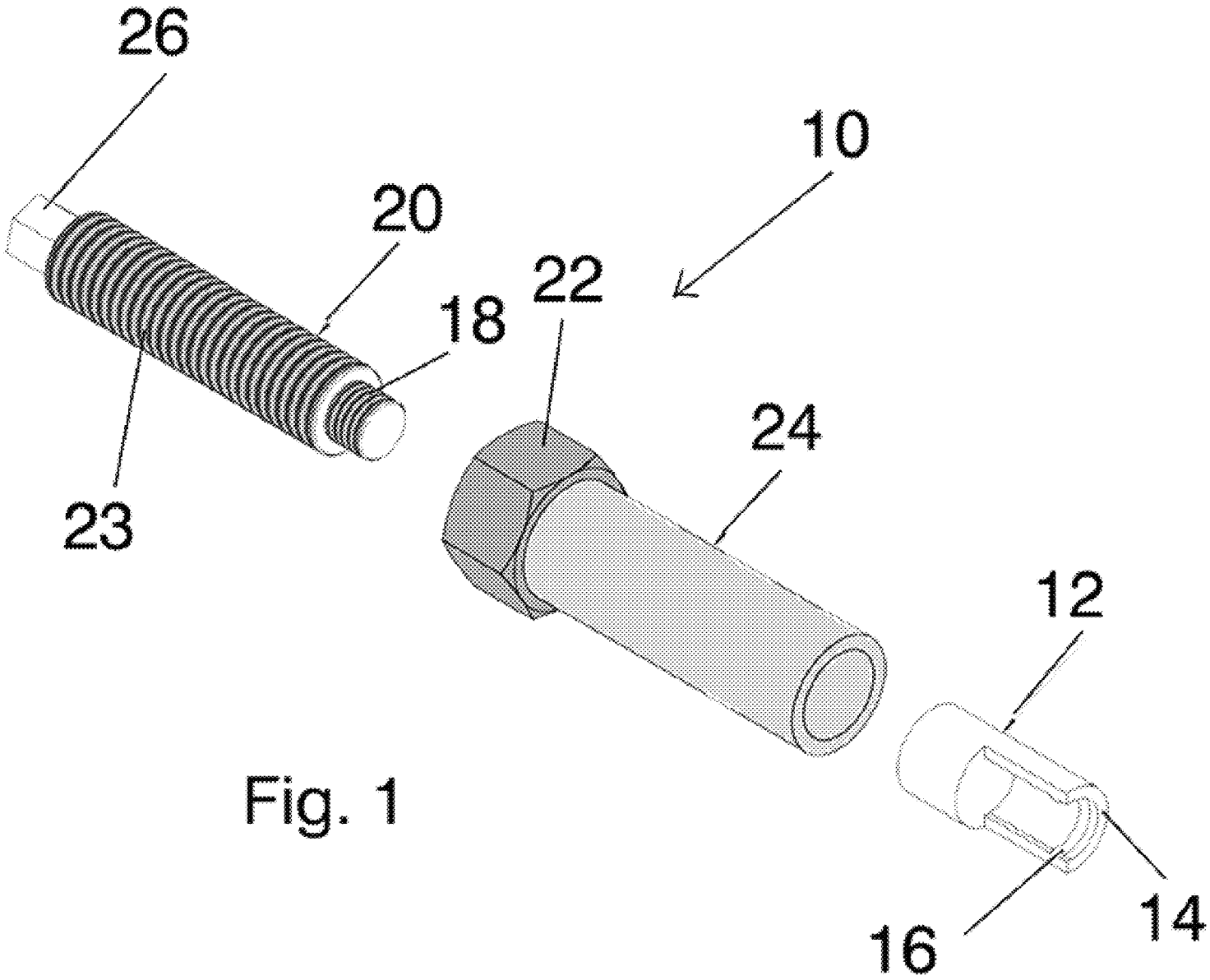
FIG. 1 is an exploded perspective view of a preferred embodiment of the bit extraction tool of the present invention.
Figure 2:
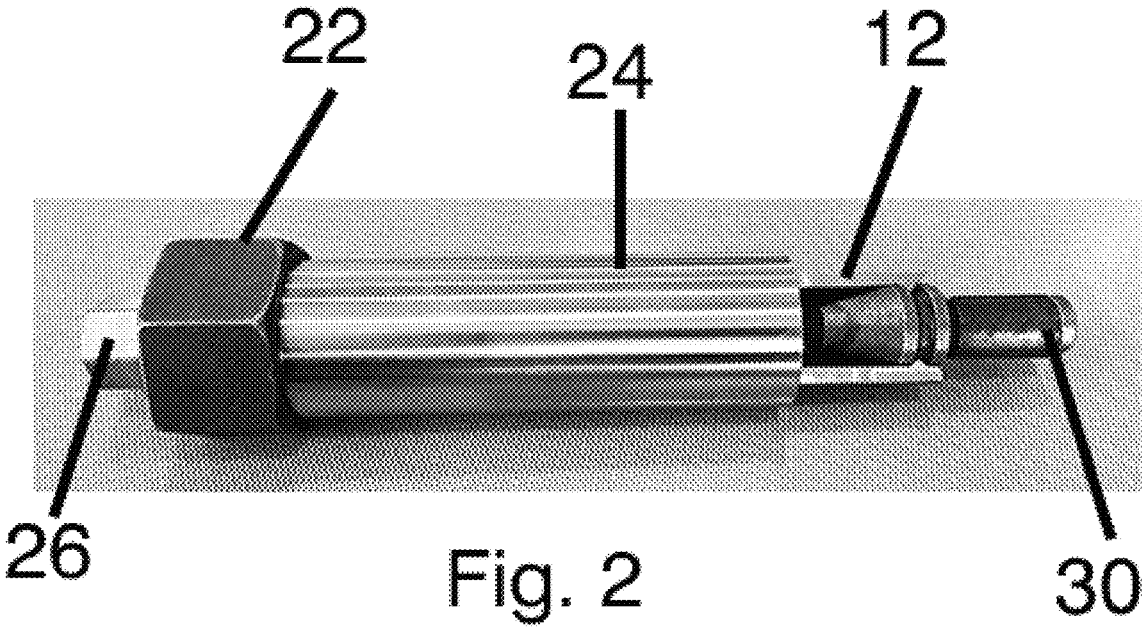
FIG. 2 is a depiction of a fully-assembled bit extraction tool, engaged to a bullet bit.
Figure 3:
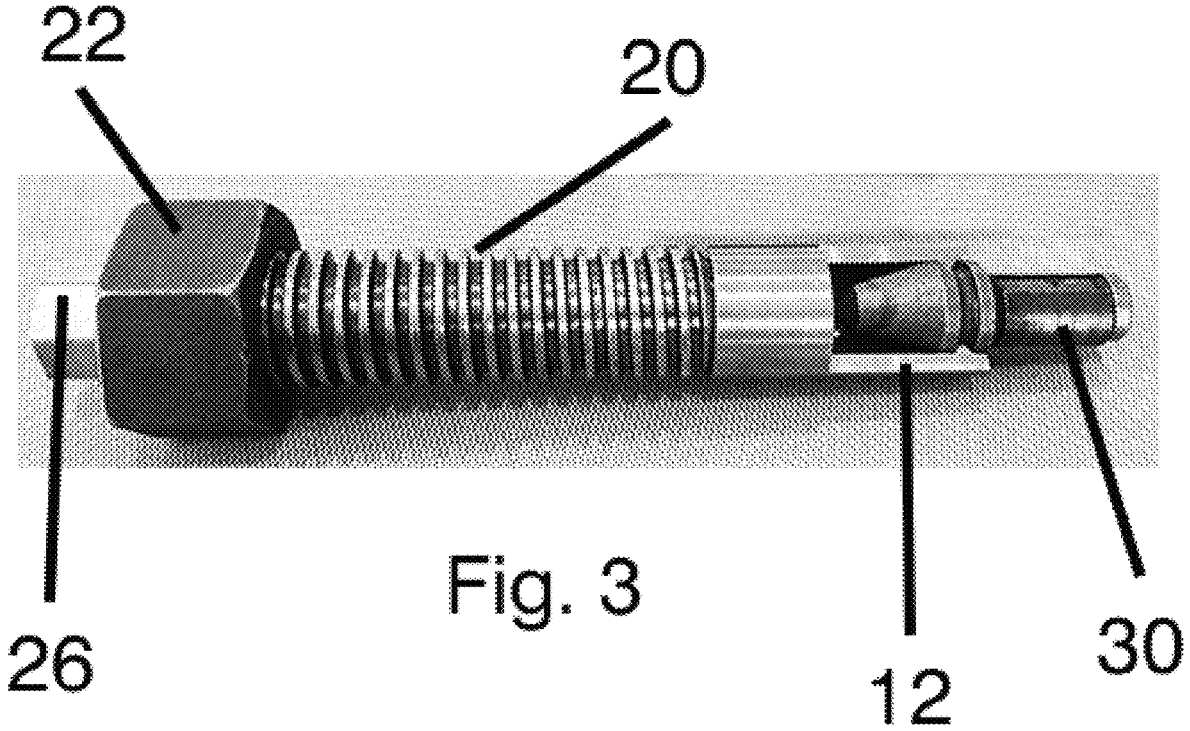
FIG. 3 is a depiction of the assembly of FIG. 2, with the pusher tube removed to fully reveal the extractor and the threaded extraction rod.

Referring to FIGS. 1-3, the bit extraction tool of the present invention is identified generally by the reference number 10. Extraction tool 10 includes in its most basic form an extractor 12, a threaded extraction rod 20, and a pusher tube 24. At least a portion of pusher tube 24 will be correspondingly threaded to engage with threaded extraction rod 20 for purposes to be discussed hereafter. In the depicted embodiment, threaded nut 22 (whether or not attached to pusher tube 24) provides the threaded engagement with threaded extraction rod 20.

In the depicted embodiment, extractor 12 is a separate component from threaded extraction rod 20, and is engaged through leakage involving threaded shank 18 with a correspondingly threaded recess in extractor 12 (not shown in the drawings). However, other embodiments involving a unitary structure that combines extractor 12 and threaded extraction rod 20 are also within the scope of the present invention.

With particular reference to FIGS. 2 and 3, engagement between extractor 12 and a bullet bit 30 involves the interface of ridge 16 situated near the terminal end of extractor 12 with a corresponding recess in bullet bit 30, as depicted in FIGS. 2 and 3. Because extractor 12 is of approximate semicircular construction, it's engagement with a to be extracted bullet bit 30 is as simple as a near instantaneous sideward sliding action.

Once extractor 12 is engaged with a bullet bit 30, pusher tube 24 is advanced to juxtapose the surfaces of the mining or excavation equipment surrounding a to be extracted bit (not shown in the drawings). This will be achieved by simply rotating nut 22 in the direction for advancing pusher tube 24 for the desired position, or, if the threaded component corresponding to nut 22 is integral to pusher tube 24, been rotating pusher tube 24 to achieve the same repositioning.

Once pusher tube is advanced into position to juxtapose services surrounding be to be removed bit, threaded extraction rod 20 is appropriately rotated to extract, through interaction with (in the depicted embodiment) nut 22 to simply pull bit 30 from its receptacle. In the case of the depicted embodiment, the terminal end of threaded extraction rod 20, Offices extract or 12, is configured for engagement with, for example, a wrench or socket. Particularly when using a socket attached to an electric or pneumatic drill, or the equivalent, extraction of a bit 30 is a near instantaneous process.

The design of the present extraction tool is such that there is virtually no risk to a user of a certain dislodging of a bit 30, nor sudden and potentially dangerous repositioning of associated tools. The process is smooth, fast, and nearly failsafe. Unlike the prior art suggested approach to bit extraction, such as discussed above, the present design is simple and cost effective to make and use.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A bit of extraction tool comprising:

an extractor portion configured for reversible sliding engagement with the annular recess of a bullet bit said extractor portion being constructed substantially as a half-cylinder, having an interior surface configured with an annular ridge means for engagement with an annular recess of a bullet bit;

a threaded extraction rod portion, from one terminal end of which extends said extractor portion; and a pusher tube with an axial opening sized for telescopic reception of said treaded extraction rod portion and extractor portion therethrough, said pusher tube having thread means configured for rotational threaded engagement with said threaded extraction rod portion.

2. The tool of claim 1 wherein said extractor portion and said threaded extraction rod portions are portions of a unitary structure, wherein said extractor portion is constructed substantially as a half-cylinder, having an interior surface configured with an annular ridge means for engagement with an annular recess of a bullet bit.

3. The tool of claim 1 wherein said extractor portion and said threaded extraction rod portions are separate components of said tool and are mechanically joined by joinder means for joining said extractor portion and said threaded extraction rod portion, and wherein said extractor portion is constructed substantially as a half-cylinder, having an interior surface configured with an annular ridge means for engagement with an annular recess of a bullet bit.

* * * * *